United States Patent [19]

Thoma et al.

[11] 4,114,821

[45] Sep. 19, 1978

[54] METHOD AND APPARATUS FOR WINDING RAPIDLY RUNNING THREAD

[75] Inventors: Georg Thoma, Leitershofen; Hans Müller, Memmingen, both of Fed. Rep. of Germany

[73] Assignee: Maschienefabrik Memmingen KG. Ing. Theodor Otto, Bavaria, Fed. Rep. of Germany

[21] Appl. No.: 711,568

[22] Filed: Aug. 4, 1976

[30] Foreign Application Priority Data

Aug. 13, 1975 [DE] Fed. Rep. of Germany ..... 2536021

[51] Int. Cl.[2] ..... B65H 54/28

[52] U.S. Cl. ..... 242/43 R; 242/18 G; 242/31; 242/175

[58] Field of Search ..... 242/43 R, 27, 31, 32, 242/18 G, 18 A, 175

[56] References Cited

U.S. PATENT DOCUMENTS

| | | | |
|---|---|---|---|
| 2,663,507 | 12/1953 | Soussloff | 242/18 A |
| 2,905,403 | 9/1959 | Pim et al. | 242/27 |

*Primary Examiner*—Stanley N. Gilreath
*Attorney, Agent, or Firm*—Holman & Stern

[57] ABSTRACT

To obtain a coherent and uniformly wound bobbin from a fast-running thread, a thread guide in the vicinity of the bobbin is subjected to a pattern of movement comprising a set of short rapid oscillating movements repeated stepwise along the length of the bobbin so that there is a slow traverse of the bobbin, followed by a rapid passing movement, which may be reciprocatory, along the bobbin to overlay the windings formed in the slow traverse.

Apparatus for performing this operation may comprise a slotted drum to impart the rapid oscillatory movement to the thread guide, and a cross-grooved shaft for shifting this drum in the axial direction.

6 Claims, 6 Drawing Figures

METHOD AND APPARATUS FOR WINDING RAPIDLY RUNNING THREAD

BACKGROUND OF THE INVENTION

This invention relates to a method of winding rapidly running thread, for example composed of glass fibres, on to a bobbin. The invention further comprises an apparatus for carrying out the method of the invention.

In the performance of winding a bobbin it is customary to apply a cross-winding using a thread guide which is subject to a plurality of different components of movement in the axial direction of the bobbin. The formation of a cross winding on bobbin produces an orderly compact structure of a roughly cylindrical external shape. Generally a thread guide controlled by a cross-grooved shaft is used to implement the cross winding. The cross-grooved shaft has two screw threads of comparatively steep pitch, one being a right-hand and the other a left-hand thread. A guide block or tenon carried or controlled by the thread guide engages in the screw threads, and devices are provided at the ends of the cross-grooved shaft to conduct the guide block or tenon from one screw thread to the other so that, with a uniform rotation of the cross-grooved shaft, the guide block carries out reciprocating movements at a substantially uniform speed. It will be apparent that delays and accelerations are produced at the time of reversal of the operation.

Satisfactory results are obtained with cross-grooved shafts at moderate winding speeds. Where, however, extremely high winding speeds are required, as for example is the case of glass fibre manufacture, a cross-grooved shaft is not entirely satisfactory. The forces generated by the great acceleration and retardation at the reversing ends of the shaft produce considerable wear during the transfer of the guide block from one thread to the other.

These acceleration and retardation forces can be reduced if the thread guide is devised to carry out a more harmonic movement. This however is not feasible because a substantially cylindrical wound package shape can only be achieved if the thread guide has consistently imposed thereon the same period of operation at every point of the bobbin circumference.

It is known to guide the thread by means of a slotted jacket through which it is delivered to the bobbin. This arrangement does not however allow for the production of a cylindrical bobbin at the high speeds referred to, and indeed the result of using this arrangement is that the winding assumes a frustoconical shape at its ends, as a consequence of which the quantity of thread in a package is considerably reduced.

It is already known to impose different components of movement to the thread guide, using a slotted jacket as the guide but, in this case the axial zone along which the slotted jacket can move is comparatively small. To enable the whole length of the bobbin to be reached the jacket itself is provided with its own drive, and is reciprocated along the complete bobbin. This art of laying in the thread, in which the cross-grooved shaft operates at substantially lesser speeds and the aforementioned difficulties are thereby avoided, does not in fact produce a useful result. There is a substantial flattening out in the zone of the ends with the increased danger that the end windings will not remain secure and will tend to loosen and drop off when winding off occurs, thus delaying the operation of the units served.

A further difficulty in the known winding methods referred to above resides in the fact that the end of the thread is not conspicuous in the finished package. This often results from the irregular appearance of the package with the end of the thread hidden. Finding the end of the winding involves further trouble and expense.

Again, a bobbin which is not sufficiently of cylindrical shape, but is of frustoconical form at the ends, produces difficulties during the run-off of the thread. If the thread is wound from the smaller diameters, the pull is less than that in the area of the larger diameter.

SUMMARY OF THE INVENTION

It is an object of the invention to provide a method and an apparatus for the winding of rapidly running threads and indeed of extremely rapidly running threads, for example of glass fibers, which are such as to secure an essentially cylindrical package which are not liable inadvertently to drop out at the ends.

A further object of the invention is to provide means for obtaining a package which has as uniform as possible an external appearance so that the end of the thread can readily be detected when the package is to be wound off.

In pursuance of these aims, by this invention the thread guide is given short rapidly oscillating movements whilst moving comparatively slowly from one end of the bobbin to the other and, after a slow passage along the complete length of the bobbin in this way, it is subject to a rapid passing movement in the axial direction.

Whilst in the known winding methods incorporating two components of movement of the thread guide, namely the short oscillating movement and the slow translation movement along the winding, these two components are applied simultaneously in accordance with a first feature of this invention a rapid passing movement along the complete length of the bobbin is always interpolated after the slow translation movement. This achieves secure fixing of the windings at the ends of the bobbin, but apart from this the winding is unimpeded and the bobbin grows at substantially the same rate at the ends as it does in the middle thereby providing a coherent cylindrical package.

An almost perfectly cylindrical package can be obtained if, as the invention further provides, the comparatively slow movement takes place stepwise. The invention can then in principle be said to virtually comprise the superimposition of three components of movement.

The first of these components is a rapid oscillating movement of comparatively small amplitude. The package obtained in this way does not per se of perfectly cylindrical shape but would exhibit marked flattenings at its ends. The windings of the package would however be secure.

Superimposed on this first movement is the stepwise axial movement of the thread guide to produce side-by-side rings or narrow annuli of windings along the bobbin.

When the complete length of winding is so established the third component of movement, namely the rapid passing movement along the whole length of the bobbin, follows. During this phase a comparatively thin thread layer is applied to the package, which has the function of fixing the plurality of individual rings or annuli which were produced by the stepwise shift movement and preventing windings from slipping or dropping off the ends. Beyond this, a rapid passing movement along the whole length of the package has the effect of equalising the surface structure and, in the finished package, shows exactly where the winding procedure has stopped. This means that there is no difficulty in identifying the end of the thread even if this is not specially marked or a special marking has been lost.

The rapid passing movement along the length of the package can be a simple translatory movement, but it is better if the rapid movement of the winding can take the form of a reciprocating movement, this improving the coherence.

In a further feature of the invention the length of step in the stepwise movement is equal to the amplitude of the oscillating movement. Somewhat better results are achieved if the step length is somewhat shorter than the amplitude of the oscillating movement, because this will mean that the individual narrow annuli are partially superimposed one on the next to improve the overall cylindrical appearance of the package. The oscillating movement can be terminated during the rapid passing movement along the length of the package, and this will help to give a uniform overall appearance to the finished package. Nevertheless an effective result can be obtained even if the oscillating movement is maintained during the passing movement.

An apparatus for carrying out this method is characterised by the fact that the thread is guided directly or indirectly by a slotted drum which is substantially uniformly driven and is carried by a shifting device which can be set to different speeds of operation. The shifting device may be a cross-grooved shaft. The slotted drum engenders the rapid oscillating movement, whilst the shifting device on the one hand produces the slow passage along the length of the package i.e. the stepwise advance and, during the changeover to the other operating speeds, the rapid movement to secure the individually laid windings.

BRIEF DESCRIPTION OF THE DRAWING

Further details of the invention are diagrammatically illustrated in the accompanying drawings in which.

DETAILED DESCRIPTION OF A PREFERRED EMBODIMENT

Figure 1:
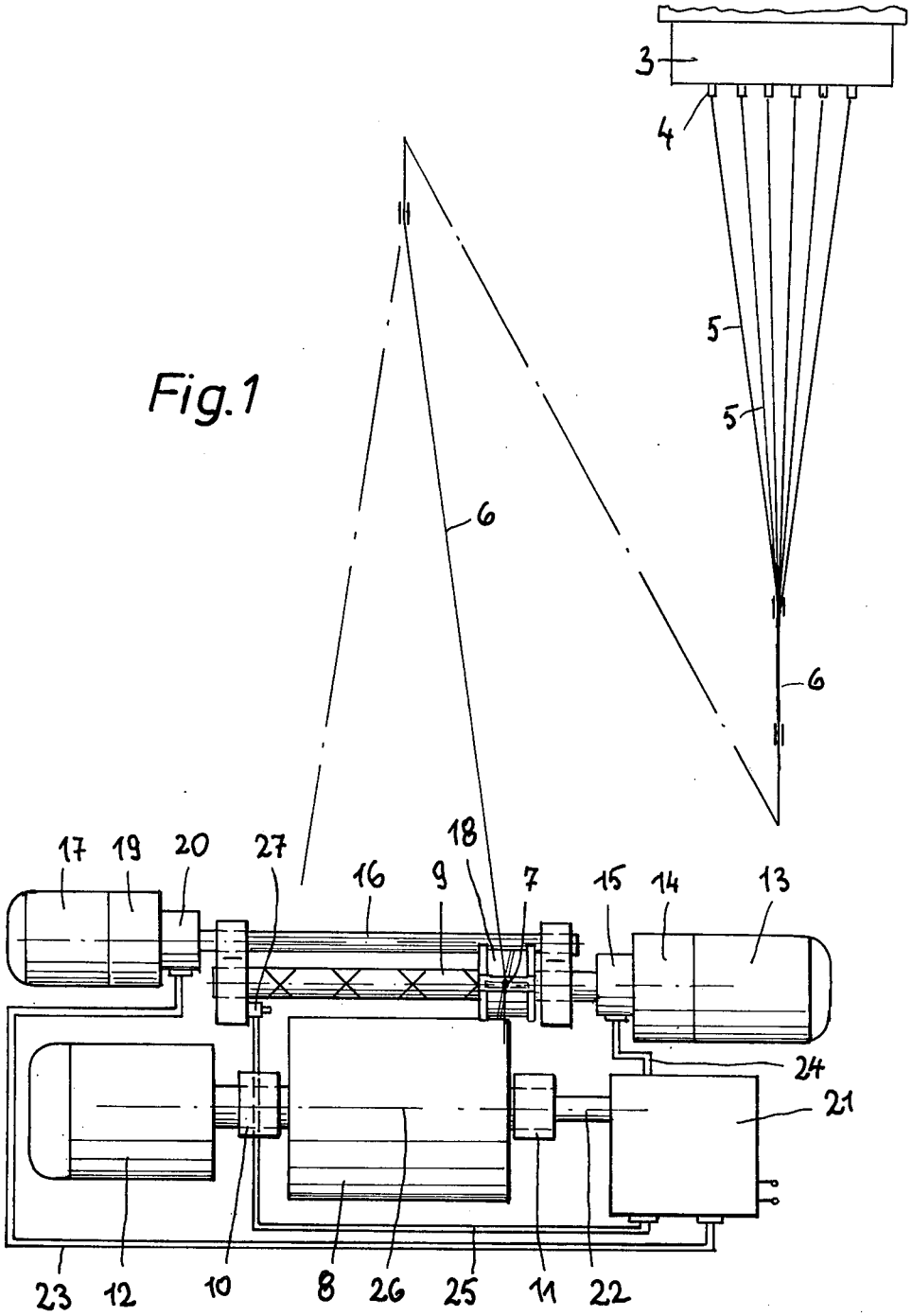
FIG. 1 is a front view of an apparatus for carrying out the method of this invention.

In the apparatus illustrated in FIG. 1, the reference numeral 3 designates diagrammatically an arrangement for producing glass fibres which emerge through the nozzles 4. The individual fibres 5 are combined together into a thread 6 which eventually passes to a thread guide 7 which in turn transfers it to a winding bobbin 8. The thread guide 7 is guided by a slotted drum 18 moved by a cross-grooved shaft 9. This arrangement will be more fully described below in reference to the illustrations in FIGS. 2 and 3.

The winding bobbin 8 is mounted on bearings 10 and 11 and is driven by a motor 12. The cross-grooved shaft 9 is driven by a further motor 13 through gearing 14 and an electromagnetic clutch 15. The drum 18 is driven through a splined shaft 16, and this shaft is operated from a motor 17 through gearing 19 and an electromagnetic clutch 20. The control parts for producing the various movements or components of movement are grouped in a control box 21 which may for example be mechanically driven by a shaft 22 from the winding bobbin 8, and a conductor 23 from clutch 20 and a conductor 24 from clutch 15 are coupled to this control box, as is also a switch 27 through conducter 25.

The details of this control box have not been illustrated in more detail because they form no part of the present invention. The components of the box may be purely electronic, and indeed other forms of control mechanism could be used. The programme of movements achieved by this arrangement is as follows.

The bobbin 8 is driven continuously by motor 12, whilst motor 17 drives the slotted drum 18 in such a way as to produce a narrow wound annulus on bobbin 8. It should be noted that during high speed winding the inertia of the thread, which is wound back and forth on the bobbin, causes an essentially trapazoidal-shaped annulus to be formed. After a predetermined period, or after a predetermined number of turns of the bobbin 8, the electromagnetic clutch 15 is operated for a predetermined period of time, or for a predetermined number of turns of the shaft 9, to shift the drum 18 one step in a direction parallel to the axis 26 of the bobbin. The result is to produce a fresh narrow winding. This is continued until the bobbin is completely wound with a plurality of these narrow wound annuli, whereupon the cross-grooved shaft 9 is brought into action through electromagnetic clutch 15 and the drum 18 is reciprocated, for example once, along the periphery of bobbin 8. This motion can for example be initiated by arranging for a predetermined number of individual step movements to be followed by an appropriately rapid passing movement, or by having the end switch 27 operated to initiate this passing movement. An end switch appropriate to this purpose can be arranged at each of the two ends of the path of travel of the slotted drum 18, although in the drawings only one single end switch 27 has been shown.

This rapid passing movement is followed by the stepwise shifting movement again relatively to the cross-grooved shaft 9. The electromagnetic clutch 20 can be disengaged during the rapid passing movement and this through control conduit 23 so that, when required, the rapid oscillating movement can be stopped during the rapid passing movement.

Figure 2:
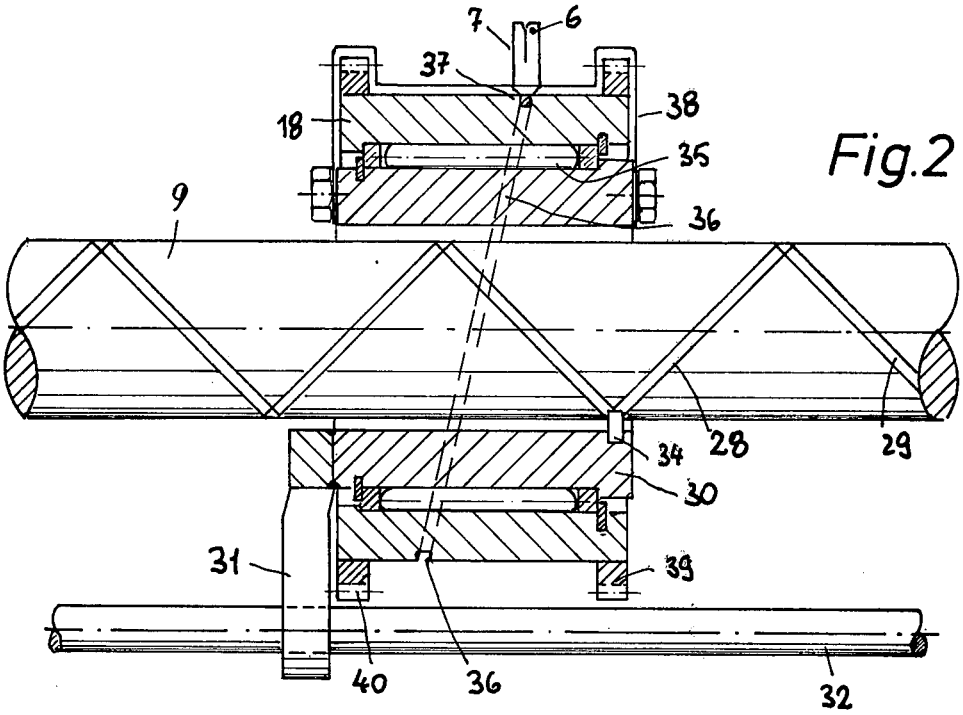
FIGS. 2 and 3 are details of the apparatus illustrated in FIG. 1, and FIGS. 4 and 5 are enlarged illustrations of parts of a wound thread developed in accordance with this invention.
Figure 3:
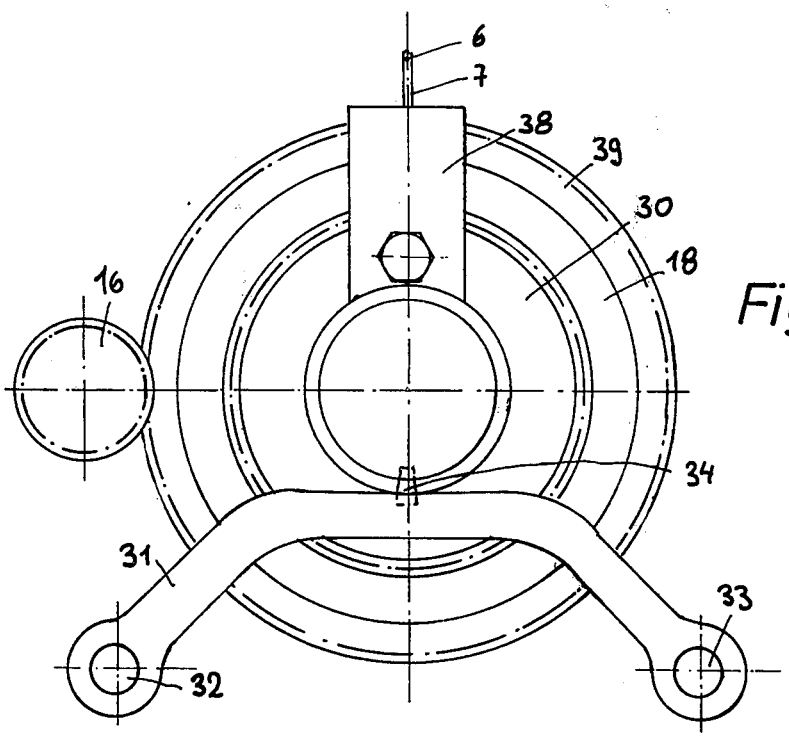

FIGS. 2 and 3 illustrate details according to the invention for implementing these movements. These drawings show the cross-grooved shaft 9 as being provided with grooves 28 and 29, groove 28 being a left-hand thread and the groove 29 being a right-hand one. Shaft 9 is surrounded by an inner ring 30 carried by a strap 31 supported on carrier rods 32 and 33 (see FIG. 3). A sliding block or tenon 34 is mounted at the inner side of ring 30 and engages in one of grooves 28 and 29 and follows the chosen groove to the end of the shaft, whereafter it engages in the opposite groove.

From this it will be seen that with the shaft turning in a continuous direction of rotation the inner ring 30 will carry out reciprocating movements in known fashion. This inner ring 30 is surrounded by the slotted drum 18 which is supported on the ring through the agency of needle bearings 35 and has a groove 36 at its periphery. Groove 36 represents a closed system. A block or tenon 37 carried by the thread guide 7 engages in the groove 36. The thread guide 7 is moreover guided in a trackway on a cover plate 38 rigidly connected to the inner ring 30.

The slotted drum 18 has teeth 39 and 40 engaging the splined shaft 16. By this means the electric motor 17, through splined shaft 16 drives the slotted drum 18 to move the thread guide 7 rapidly to and from in accordance with the pitch of the track in groove 36.

It will be apparent that other constructional arrangements could be used instead of the slotted drum in the embodiment illustrated. The method of this invention can moreover be implemented by other drive-imparting means, although a slotted drum has the advantage that it involves rotary masses only.

The thread guide 7 comprises a resilient wire structure in which the thread can be inserted. Its mess is small so that the resulting inertial forces are small.

Figure 4:
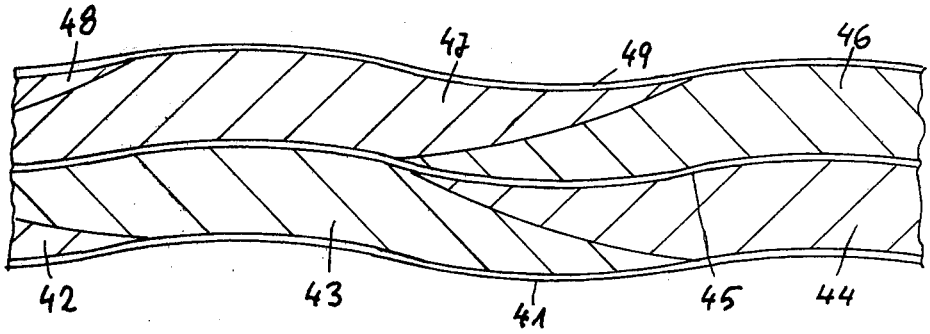
Figure 5:
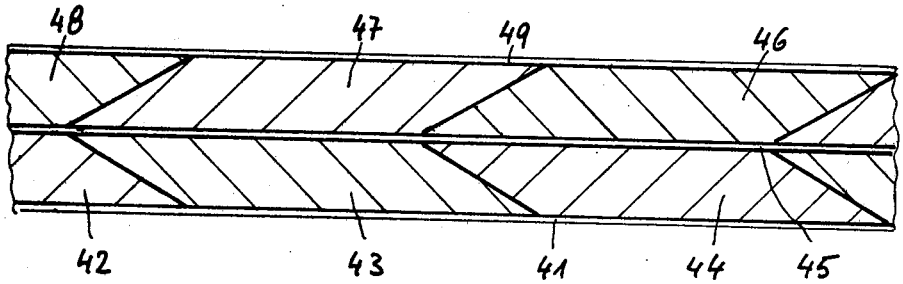

FIGS. 4 and 5 illustrate diagrammatically the product of the method of the invention, these showing in each case a section of one of two annularly wound layers.

In the case of FIG. 4 it is assumed that a slightly undulated external surface is produced by the preceding layering. The rapid passing movement produces the layer 41. The thread guide now lays the narrow wound annuli 42, 43 and 44 alongside one another but partially superimposed. It is also possible to so arrange the process that the individual wound annuli are separate from one another.

Finally layer 45 is formed and this by a rapid double passing movement, although a single passing movement could be substituted therefore. This is followed by the narrow wound annuli 46, 47 and 48 which again are protected by the layer 49.

Although the outer surface of the finished package is not completely cylindrical in the case of the embodiment illustrated in FIG. 4 a large part of the advantage aimed at is secured. In particular the slight undulation will not be amplified in the course of the further winding. Thus if required the control can be exercised in such a way that if there is an inclination to form undulations the layer made up of the wound annuli 46, 47 and 48 can be offset relatively to the preceding layer by half a step length so that the resulting valleys are filled.

Figure 6:
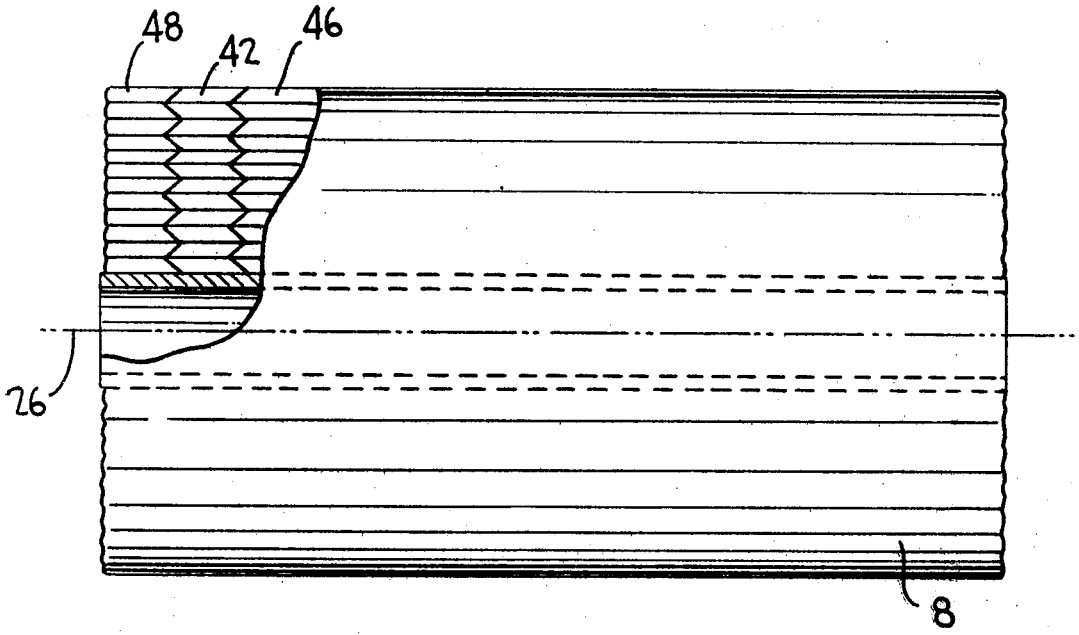
FIG. 6 is a partial cross-sectional view of the thread layers of the present invention.

The arrangement illustrated in FIG. 5 shows how, despite the fact that the narrow winding annuli have per se conical end tips, it is possible to obtain a wound package which is substantially of cylindrical form as can be seen in FIG. 6. It should be noted that the winding 43 is applied in a trapazoidal shape, but due to the overlap onto annulus 42, the resultant shape is that of a parallelepiped.

We claim:

1. In method of winding fast running thread on a winding bobbin, by means of a thread guide to which a plurality of different components of movement in the axial direction of the winding bobbin are applied, the improvement comprises the steps of: applying to the thread guide short, rapid oscillating movements of a length less than the length of the bobbin; moving the thread guide stepwise slowly from one end of the bobbin to the other; and after this stepwise traverse of the length of the bobbin subjecting the thread guide to a rapid passing movement over the length of the bobbin.

2. A method according to claim 1, in which the length of each step is no greater than the length of said rapid oscillating movement.

3. A method according to claim 1, including the additional step of stopping said oscillating movement during said rapid passing movement step.

4. A method according to claim 1, in which said rapid passing movement is performed as reciprocating travel.

5. Apparatus for the winding of fast running thread on a winding bobbin comprising: a bobbin with an axis; a slotted drum rotatably mounted adjacent to and movable in the axial direction of said bobbin; a thread guide engaged in the slot in said slotted drum; means for driving said slotted drum and forcing said thread guide to follow a reciprocating axial movement having a length of movement less than said bobbin; a shifting device engaged with said slotted drum for stepwise moving said drum in an axial direction; and means for operating said shifting device at variable speeds.

6. Apparatus as claimed in claim 5, in which said shifting device is a crossgrooved shaft.

* * * * *